US006225266B1

(12) United States Patent
Watts et al.

(10) Patent No.: US 6,225,266 B1
(45) Date of Patent: May 1, 2001

(54) ZINC-FREE CONTINUOUSLY VARIABLE TRANSMISSION FLUID

(75) Inventors: Raymond F. Watts, Long Valley; Katherine M. Richard, Fanwood, both of NJ (US)

(73) Assignee: Infineum USA L.P., Linden, NJ (US)

( * ) Notice: Subject to any disclaimer, the term of this patent is extended or adjusted under 35 U.S.C. 154(b) by 0 days.

(21) Appl. No.: 09/322,937

(22) Filed: May 28, 1999

(51) Int. Cl.[7] ..... C10M 141/12

(52) U.S. Cl. ..... 508/193; 508/195; 508/196; 508/291; 508/432; 508/434; 508/554; 508/574

(58) Field of Search ..... 508/193, 195, 508/196, 291, 432, 434, 554, 574

(56) References Cited

U.S. PATENT DOCUMENTS 3,197,405 * 7/1965 LeSuer .
4,129,508 * 12/1978 Friihauf .
4,280,916 * 7/1981 Richards et al. .
5,078,893 * 1/1992 Ryer et al. .
5,320,768 * 6/1994 Gutierrez et al. .
5,641,732 * 6/1997 Bloch et al. .
5,750,476 * 5/1998 Nibert et al. .
5,750,477 * 5/1998 Sumiejski et al. ..... 508/331
5,916,852 * 6/1999 Nibert et al. .
5,972,851 * 10/1999 Srinivasan et al. .

FOREIGN PATENT DOCUMENTS

WO98/39400 * 9/1998 (WO) ..... C10M/141/00

* cited by examiner

*Primary Examiner*—Jerry D. Johnson

(57) ABSTRACT

A zinc-free lubricating composition for lubricating a continuously variable transmission, the lubricating composition comprising a mixture of a major amount of a lubricating oil and an effective amount of a performance enhancing additive combination comprising: (a) an ashless dispersant; (b) at least one organic phosphite; (c) a calcium detergent; (d) one or more friction modifiers selected from the group consisting of: succinimides and ethoxylated amines; and (e) a primary amide of a long chain carboxylic acid.

18 Claims, 2 Drawing Sheets

ZINC-FREE CONTINUOUSLY VARIABLE TRANSMISSION FLUID

FIELD OF THE INVENTION

This invention relates to a composition and a method for lubricating a steel belt continuously variable transmission (CVT). More particularly, the present invention is directed to a zinc-free lubricating composition useful as a continuously variable transmission fluid which exhibits enhanced low temperature friction characteristics versus conventional fluids.

BACKGROUND OF THE INVENTION

The continuing pursuit of more fuel efficient motor vehicles has led to the development of continuously variable transmissions by a number of manufacturers. The major difference between a continuously variable transmission and a conventional automatic transmission is that automatic transmissions use planetary gear sets to accomplish speed changes, whereas a continuously variable transmission uses pulleys and a belt to change speed. A conventional automatic transmission normally has 3, 4 or 5 fixed reduction ratios or "speeds", e.g., a 5-speed automatic transmission. The operating system of the transmission selects the appropriate reduction ratio, or speed, based on engine rpm, ground speed and throttle position. In a continuously variable transmission an almost infinite number of reduction ratios, within fixed limits, can be achieved by changing the relative radius of travel of the driving belt on the driving and driven pulleys.

The critical mechanism in the CVT is the variator. The variator is composed of two steel pulleys and a steel belt. The pulleys can be opened and closed thereby allowing the belt to travel at different radiuses. When the driving pulley is fully opened (small radius of belt travel) and the driven pulley is fully closed (large radius of belt travel) very high reduction ratios are achieved (yielding low ground speeds). Conversely, when the driving pulley is fully closed (large radius of belt travel) and the driven pulley is fully opened (small radius of belt travel) increases in output speed over input speed are achieved (yielding high ground speeds).

The novelty of this design is that the belt is made of steel. Two types of CVT transmissions exist. In one design, the belt is "pushed" or compressed to transmit power, and in the other the belt is pulled, as is more common with a V-belt. Since in both designs steel belts are used in contact with steel pulleys, the lubrication requirements are identical for both design types.

There are two critical requirements for the lubricants used in CVT transmissions: (1) control of wear and (2) control of friction. Since steel-on-steel coefficients of friction tend to be very low, e.g., 0.03 to 0.15, extremely high closing forces are applied to the pulley sides to keep the belt from slipping. Any slippage of the belt causes catastrophic wear, which quickly leads to failure. The pulleys are made to exacting limits and have a precise surface finish to allow optimum operation. No wear of these surfaces can be allowed. Therefore, an appropriate lubricant must have excellent wear control. The frictional characteristics of the belt-pulley interface are also critical. The friction must be very high to prevent slippage of the belt during transmission of high torque from the engine to the drive wheels. Too high a static coefficient of friction, however, can cause "slip-stick" behavior of the belt which leads to oscillation and audible noise in the passenger compartment of the vehicle. This "whistling" of the belt is highly undesirable.

As indicated above, fluids with too high a static, or low speed coefficient of friction are likely to cause stick-slip behavior in the transmission. Since the objective of using a CVT is to produce a vehicle with improved fuel efficiency, they are often fitted with a slipping torque converter clutch. The fuel efficiency gains possible with slipping torque converter clutches are well documented. Stick-slip behavior, when not prevented by the lubricant, manifests itself as whistling noise in the belt or vibration in the slipping torque converter clutch.

In order to successfully prevent stick-slip behavior in the slipping torque converter clutch or variator it is essential that the lubricant have excellent control of friction at low sliding speeds. More specifically the lubricant must provide a non-stick-slip friction environment at low sliding speeds. This friction characteristic is determined by calculating the friction versus velocity relationship or $d\mu/dV$ [the change of friction coefficient ($\mu$) with changing velocity (V)] of the system, where the system is defined as the lubricant and friction material being used. To successfully control stick slip behavior, this relationship, the $d\mu/dV$, must always be positive, i.e. the friction coefficient must always increase with increasing sliding speed or velocity. Moreover, the more positive the $d\mu/dV$ the greater safety margin the lubricant provides against stick-slip behavior.

Since transmissions in motor vehicles are used over a wide range of ambient temperatures it is not only important for the lubricant to possess a positive $d\mu/dV$ at one temperature, but also over a wide range of temperatures. It is this aspect of fluid performance, the control of $d\mu/dV$ over a wide range of temperatures, more specifically at lower temperatures, in the range of about 40° C., that this invention addresses.

Prior attempts have been made to formulate a continuously variable transmission fluid which provides the appropriate amount of lubrication, while allowing sufficient friction between the belt and the pulleys to avoid slippage of the belt during transmission of high torque from the engine. One such lubricating fluid is disclosed in WO 98/39400, published Sep. 11, 1998, which describes a lubricating composition comprising a mixture of: (1) a major amount of a lubricating oil; and (2) an effective amount of a performance enhancing additive combination comprising: (a) an ashless dispersant, (b) a metallic detergent, (c) an organic phosphite, (d) an amine salt of an organic phosphate, and (e) one or more friction modifiers, e.g., an amide friction modifier, a succinimide friction modifier and an ethoxylated amine friction modifier. See also U.S. Pat. No. 5,750,477 (Sumiejski et al.), which issued on May 12, 1998, and which is incorporated herein by reference. These lubricants however have not addressed the control of $d\mu/dV$, especially at low temperatures.

We have now found a unique combination of additives and friction modifiers that solve the difficult lubrication problems created by combination of the steel-on-steel pulley system and slipping torque converter clutch in a continuously variable transmission. In particular, the present inventors have discovered a unique zinc-free continuously variable transmission (CVT) fluid which exhibits substantially improved friction characteristics ($d\mu/dV$) at low temperatures (e.g. 40° C.) That is, the lubricant of the present invention is particularly suited for CVT applications due its ability to provide high steel-on-steel friction coefficients and its ability to maintain a positive $d\mu/dV$ over an expanded temperature range. This improvement in operating temperature range is accomplished by the addition of a primary amide of a long chain carboxylic acid into the additive.

SUMMARY OF THE INVENTION

This invention relates to a composition and a method of lubricating a continuously variable transmission comprising:

(1) a major amount of a zinc-free lubricating oil; and (2) an effective amount of a performance enhancing additive combination comprising:

(a) an ashless dispersant;

(b) an organic phosphite;

(c) a calcium detergent;

(d) one or more friction modifiers chosen from:

(1) succinimides, and (2) ethoxylated amines; and (e) a primary amide of a long chain carboxylic acid.

The primary amide of the long chain carboxylic acid is represented by the structure below:

$$RCONH_2$$

wherein R is preferably an alkenyl or alkyl group having about 12 to 24 carbons, more preferably 16 to 20 carbons, and most preferably is a $C_{17}$ alkenyl group. The preferred primary amide is oleamide. The primary amide is preferably present in an amount between about 0.001 to 1.0 wt. %, based upon the weight percent of the fully formulated oil composition, more preferably 0.001 to 0.5 wt. % and most preferably present in an amount of 0.1 wt. %.

A further embodiment of this invention is a continuously variable transmission containing the fluids of this invention.

DETAILED DESCRIPTION OF THE INVENTION

Figure 1A:
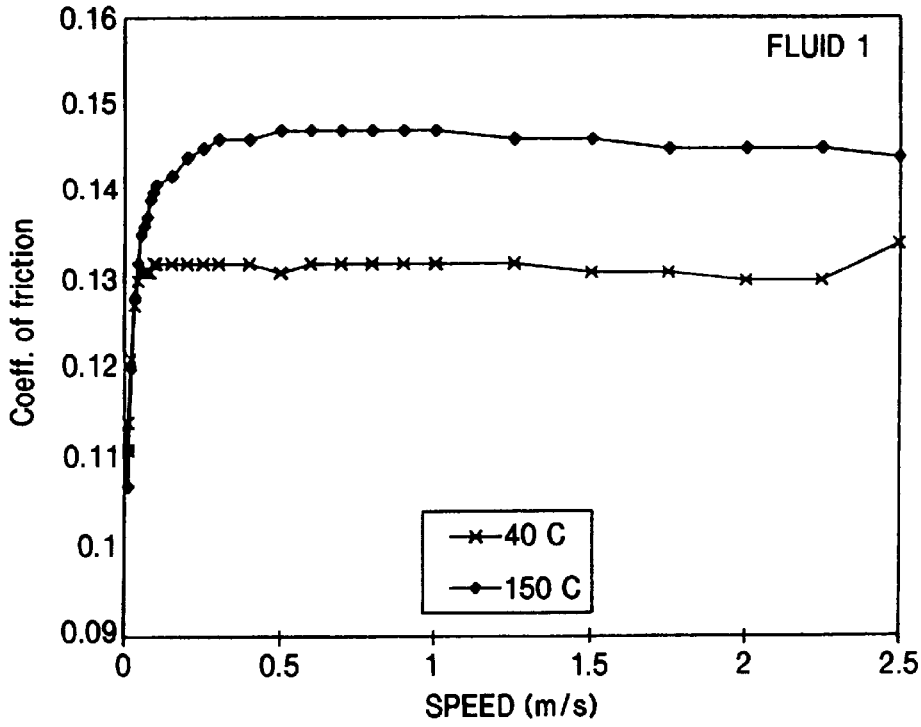
FIGS. 1*a* and 1*b* are graphs depicting the friction versus velocity curves for two lubricants at both 40° C. and 150° C. prior to any aging (fresh fluid)

Lubricating a CVT transmission equipped with a steel-on-steel friction variator and a slipping torque converter clutch system is not a simple matter. It presents a unique problem of providing high steel-on-steel friction for the variator and excellent paper-on-steel friction for the torque converter clutch. Added to these requirements is that the fluid possess a positive $d\mu/dV$ over a wide range of operating temperatures. Therefore, the friction modifier system must be selected so as to provide very precise control of the steel-on-steel friction and the paper-on-steel friction over a wide range of temperatures.

1. Lubricating Oils

Lubricating oils useful in this invention are derived from natural lubricating oils, synthetic lubricating oils, and mixtures thereof In general, both the natural and synthetic lubricating oil will each have a Kinematic viscosity ranging from about 1 to about 100 $mm^2/s$ (cSt) at 100° C., although typical applications will require the lubricating oil or lubricating oil mixture to have a viscosity ranging from about 2 to about 8 $mm^2/s$ (cSt) at 100° C.

Natural lubricating oils include animal oils, vegetable oils (e.g., castor oil and lard oil), petroleum oils, mineral oils, and oils derived from coal or shale. The preferred natural lubricating oil is mineral oil.

Suitable mineral oils include all common mineral oil basestocks. This includes oils that are naphthenic or paraffinic in chemical structure. Oils that are refined by conventional methodology using acid, alkali, and clay or other agents such as aluminum chloride, or they may be extracted oils produced, for example, by solvent extraction with solvents such as phenol, sulfur dioxide, furfural, dichlorodiethyl ether, etc. They may be hydrotreated or hydrofined, dewaxed by chilling or catalytic dewaxing processes, or hydrocracked. The mineral oil may be produced from natural crude sources or be composed of isomerized wax materials or residues of other refining processes.

Typically the mineral oils will have Kinematic viscosities of from 2.0 $mm^2/s$ (cSt) to 8.0 $mm^2/s$ (cSt) at 100° C. The preferred mineral oils have Kinematic viscosities of from 2 to 6 $mm^2/s$ (cSt), and most preferred are those mineral oils with viscosities of 3 to 5 $mm^2/s$ (cSt) at 100° C.

Synthetic lubricating oils include hydrocarbon oils and halo-substituted hydrocarbon oils such as oligomerized, polymerized, and interpolymerized olefins [e.g., polybutylenes, polypropylenes, propylene, isobutylene copolymers, chlorinated polylactenes, poly(1-hexenes), poly (1-octenes), poly-(1-decenes), etc., and mixtures thereof]; alkylbenzenes [e.g., dodecyl-benzenes, tetradecylbenzenes, dinonyl-benzenes, di(2-ethylhexyl)benzene, etc.]; polyphenyls [e.g., biphenyls, terphenyls, alkylated polyphenyls, etc.]; and alkylated diphenyl ethers, alkylated diphenyl sulfides, as well as their derivatives, analogs, and homologs thereof, and the like. The preferred oils from this class of synthetic oils are oligomers of α-olefins, particularly oligomers of 1-decene.

Synthetic lubricating oils also include alkylene oxide polymers, interpolymers, copolymers, and derivatives thereof where the terminal hydroxyl groups have been modified by esterification, etherification, etc. This class of synthetic oils is exemplified by: polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polypropylene glycol having a molecular weight of 1000 to 1500); and mono- and polycarboxylic esters thereof (e.g., the acetic acid esters, mixed $C_3$–$C_8$ fatty acid esters, and $C_{12}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebasic acid with two moles of tetraethylene glycol and two moles of 2-ethyl-hexanoic acid, and the like. A preferred type of oil from this class of synthetic oils are adipates of $C_4$ to $C_{12}$ alcohols.

Esters useful as synthetic lubricating oils also include those made from $C_5$ to $C_{12}$ monocarboxylic acids and polyols and polyol ethers such as neopentyl glycol, trimethylolpropane pentaerythritol, dipentaerythritol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra-(p-tert-butylphenyl) silicate, hexa-(4-methyl- 2-pentoxy)-disiloxane, poly(methyl)-siloxanes and poly (methylphenyl) siloxanes, and the like. Other synthetic lubricating oils include liquid esters of phosphorus-containing acids (e.g., tricresyl phosphate, trioctyl phosphate, and diethyl ester of decylphosphonic acid), polymeric tetrahydrofurans, poly-α-olefins, and the like.

The lubricating oils may be derived from refined, rerefined oils, or mixtures thereof Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and are often additionally processed by techniques for removal of spent additives and oil breakdown products.

When the lubricating oil is a mixture of natural and synthetic lubricating oils (i.e., partially synthetic), the choice of the partial synthetic oil components may widely vary, however, particularly useful combinations are comprised of mineral oils and poly-α-olefins (PAO), particularly oligomers of 1-decene.

2. Additive Composition a. Ashless Dispersants

The lubricating oil is combined with an additive formulation. One component of the additive system of the current invention is an ashless dispersant. Suitable dispersants for use in this invention include hydrocarbyl succinimides, hydrocarbyl succinamides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Also useful are condensation products of polyamines and hydrocarbyl substituted phenyl acids. Mixtures of these dispersants can also be used.

Basic nitrogen containing ashless dispersants are well known lubricating oil additives, and methods for their preparation are extensively described in the patent literature. For example, hydrocarbyl-substituted succinimides and succinamides and methods for their preparation are described, for example, in U.S. Pat. Nos. 3,018,247; 3,018,250; 3,018,291; 3,361,673 and 4,234,435. Mixed ester-amides of hydrocarbyl-substituted succinic acids are described, for example, in U.S. Pat. Nos: 3,576,743; 4,234,435 and 4,873,009. Mannich dispersants, which are condensation products of hydrocarbyl-substituted phenols, formaldehyde and polyamines are described, for example, in U.S. Pat. Nos. 3,368,972; 3,413,347; 3,539,633; 3,697,574; 3,725,277; 3,725,480; 3,726,882; 3,798,247; 3,803,039; 3,985,802; 4,231,759 and 4,142,980. Amine dispersants and methods for their production from high molecular weight aliphatic or alicyclic halides and amines are described, for example, in U.S. Pat. No. 3,275,554; 3,438,757; 3,454,55 and 3,565,804.

The preferred dispersants are the alkenyl succinimides and succinamides. The succinimide or succinamide dispersants can be formed from amines containing basic nitrogen and additionally one or more hydroxy groups. Usually, the amines are polyamines such as polyalkylene polyamines, hydroxy-substituted polyamines and polyoxyalkylene polyamines. Examples of polyalkylene polyamines include diethylene triamine, triethylene tetramine, tetraethylene pentamine, pentaethylene hexamine. Low cost poly (ethyleneamines) (PAM's) averaging about 5 to 7 nitrogen atoms per molecule are available commercially under trade names such as "Polyamine H", "Polyamine 400", Dow Polyamine E-100", etc. Hydroxy-substituted amines include N-hydroxyalkyl-alkylene polyamines such as N-(2-hydroxyethyl)ethylene diamine, N-(2-hydroxyethyl) piperazine, and N-hydroxyalkylated alkylene diamines of the type described in U.S. Pat. No. 4,873,009. Polyoxyalkylene polyamines typically include polyoxyethylene and polyoxypropylene diamines and triamines having average molecular weights in the range of 200 to 2500. Products of this type are available under the Jeffamine trademark.

The amine is readily reacted with the selected hydrocarbyl-substituted dicarboxylic acid material, e.g., alkylene succinic anhydride, by heating an oil solution containing 5 to 95 wt. % of said hydrocarbyl-substituted dicarboxylic acid material at about 100° to 250° C., preferably 125° to 175° C., generally for 1 to 10, e.g., 2 to 6 hours until the desired amount of water is removed. The heating is preferably carried out to favor formation of imides or mixtures of imides and amides, rather than amides and salts. Reaction ratios of hydrocarbyl-substituted dicarboxylic acid material to equivalents of amine as well as the other nucleophilic reactants described herein can vary considerably, depending on the reactants and type of bonds formed. Generally from 0.1 to 1.0, preferably from about 0.2 to 0.6, e.g., 0.4 to 0.6, equivalents of dicarboxylic acid unit content (e.g., substituted succinic anhydride content) is used per reactive equivalent of nucleophilic reactant, e.g., amine. For example, about 0.8 mole of a pentamine (having two primary amino groups and five reactive equivalents of nitrogen per molecule) is preferably used to convert into a mixture of amides and imides, a composition derived from reaction of polyolefin and maleic anhydride having a functionality of 1.6; i.e., preferably the pentamine is used in an amount sufficient to provide about 0.4 equivalents (that is, 1.6 divided by (0.8×5) equivalents) of succinic anhydride units per reactive nitrogen equivalent of the amine.

Use of alkenyl succinimides which have been treated with a boronating agent are also suitable for use in the compositions of this invention as they are much more compatible with elastomeric seals made from such substances as fluoroelastomers and silicon-containing elastomers. Dispersants may be post-treated with many reagents known to those skilled in the art. (see, e.g., U.S. Pat. Nos. 3,254,025, 3,502,677 and 4,857,214).

The preferred ashless dispersants are polyisobutenyl succinimides formed from polyisobutenyl succinic anhydride and an alkylene polyamine such as triethylene tetramine or tetraethylene pentamine wherein the polyisobutenyl substituent is derived from polyisobutene having a number average molecular weight in the range of 700 to 1200 (preferably 900 to 1100). It has been found that selecting certain dispersants within the broad range of alkenyl succinimides produces fluids with improved frictional characteristics. The most preferred dispersants of this invention are those wherein the polyisobutene substituent group has a molecular weight of approximately 950 atomic mass units, the basic nitrogen containing moiety is polyamine (PAM) and the dispersant has been post treated with a boronating agent.

The ashless dispersants of the invention can be used in any effective amount. However, they are typically used from about 0.1 to 10.0 mass percent in the finished lubricant, preferably from about 0.5 to 7.0 percent and most preferably from about 2.0 to about 5.0 percent.

b. Organic Phosphites

The second component of the additive system of the current invention is an oil soluble organic phosphite. The organic phosphites useful in this invention preferably are the mono-, and di-hydrocarbyl phosphites having the general structure I, where structure I is represented by:

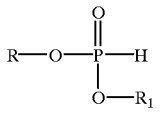

where R is hydrocarbyl and $R_1$ is hydrocarbyl or hydrogen; preferably R or $R_1$ contains a thioether ($CH_2$—S—$CH_2$) group. As used herein, the term "hydrocarbyl" denotes a group having a carbon atom directly attached to the remainder of the molecule and having predominantly hydrocarbon character within the context of this invention. Such groups include the following: (1) hydrocarbon groups; that is, aliphatic, alicyclic (e.g., cycloalkyl or cycloalkenyl), aromatic groups, alkaryl groups, and the like, as well as cyclic groups wherein the ring is completed through another portion of the molecule; (2) substituted hydrocarbon groups; that is, groups containing non-hydrocarbon substituents which in the context of this invention, do not alter the predominantly hydrocarbon nature of the group. Those skilled in the art will be aware of suitable substituents. Examples include, halo, hydroxy, nitro, cyano, alkoxy, acyl, etc.; (3) hetero groups; that is, groups which while predominantly hydrocarbon in character within the context of this invention, contain atoms of other than carbon in a chain or ring otherwise composed of carbon atoms. Suitable hetero atoms will be apparent to those skilled in the art and include, for example, nitrogen, oxygen and sulfur.

In structure I, when R or $R_1$ is an alkyl, the alkyl groups are $C_4$ to $C_{20}$, preferably $C_6$ to $C_{18}$, most preferably $C_8$ to $C_{16}$. Such groups are known to those skilled in the art. Examples include methyl, ethyl, octyl, decyl, octadecyl, cyclohexyl and phenyl, etc. R or $R_1$ can also vary independently. As stated, R and $R_1$ can be alkyl, or aralkyl, may be linear or branched, and the aryl groups may be phenyl or substituted phenyl. The R and $R_1$ groups may be saturated or unsaturated, and they may contain hetero atoms such as S, N or O. The preferred materials are the dialkyl phosphites (structure I). The R and $R_1$ groups are preferably linear alkyl groups from $C_4$ to $C_{18}$ containing one sulfur atom. The most preferred are decyl, undecyl, 3-thiaundecyl, pentadecyl and 3-thiapentadecyl.

Phosphites of structure I may be used individually or in mixtures.

The preferred embodiment of this invention is the use of the mixed alkyl phosphites described in U.S. Pat. Nos. 5,185,090 and 5,242,612.

While any effective amount of the organic phosphite may be used to achieve the benefits of the invention, typically these effective amounts will be from 0.01 to 5.0 mass percent in the finished fluid. Preferably the treat rate in the fluid will be from 0.2% to 3.0% and most preferred is 0.3% to 1.0%.

Examples for producing representative mixed organic phosphites are given below.

EXAMPLE P-1-A

An alkyl phosphite mixture was prepared by placing in a round bottom 4-neck flask equipped with a reflux condenser, a stirring bar and a nitrogen bubbler, 246 grams (1 mol) of hydroxyethyl-n-dodecyl sulfide, 122 grams (1 mol) of thiobisethanol, and 194 grams (1 mol) of dibutyl phosphite. The flask was flushed with nitrogen, sealed and the stirrer started. The contents were heated to 95° C. under vacuum (−60 kPa). The reaction temperature was maintained at 95° C. until approximately 59 mL of butyl alcohol were recovered as overhead in a chilled trap. Heating was continued until the TAN (Total Acid Number) of the reaction mixture reached about 110. This continued heating took approximately 3 hours, during which time no additional butyl alcohol was evolved. The reaction mixture was cooled and 102 grams of a baseoil sold under the trademark Necton-37® and available from Exxon Company USA, was added. The final product was analyzed and found to contain 5.2% phosphorus and 11.0% sulfur.

EXAMPLE P-1-B

A phosphorus- and sulfur-containing reaction product was prepared by placing in a round bottom 4-neck flask equipped with a reflux condenser, a stirring bar and a nitrogen bubbler, 194 grams (1 mole) of dibutyl hydrogen phosphite. The flask was flushed with nitrogen, sealed and the stirrer started. The dibutyl hydrogen phosphite was heated to 150° C. under vacuum (−90 KPa). The temperature in the flask was maintained at 150° C. while 190 grams (1 mole) of hydroxyethyl-n-octyl sulfide was added over about one hour. During the addition approximately 35 ml's of butyl alcohol were recovered as overhead in a chilled trap. Heating was continued for about one hour after the addition of the hydroxyethyl-n-octyl sulfide was completed, during which time no additional butyl alcohol was evolved. The reaction mixture was cooled and analyzed for phosphorus and sulfur. The final product had a TAN of 115 and contained 8.4 % phosphorus and 9.1 % sulfur.

c. Calcium Detergents

The calcium-containing detergents of the compositions of this invention are exemplified by oil-soluble neutral or overbased calcium salts of one or more of the following acidic substances (or mixtures thereof): (1) sulfonic acids, (2) carboxylic acids, (3) salicylic acids, (4) alkyl phenols and (5) sulfurized alkyl phenols.

Oil-soluble neutral metal-containing detergents are those detergents that contain stoichiometrically equivalent amounts of metal in relation to the amount of acidic moieties present in the detergent. Thus, in general the neutral detergents will have a low basicity when compared to their overbased counterparts. The acidic materials utilized in forming such detergents include carboxylic acids, salicylic acids, alkylphenols, sulfonic acids, sulfurized alkylphenols and the like.

The term "overbased" in connection with metallic detergents is used to designate metal salts wherein the metal is present in stoichiometrically larger amounts than the organic radical. The commonly employed methods for preparing the over-based salts involve heating a mineral oil solution of an acid with a stoichiometric excess of a metal neutralizing agent such as the metal oxide, hydroxide, carbonate, bicarbonate, of sulfide at a temperature of about 50° C., and filtering the resultant product. The use of a "promoter" in the neutralization step to aid the incorporation of a large excess of metal likewise is known. Examples of compounds useful as the promoter include phenolic substances such as phenol, naphthol, alkyl phenol, thiophenol, sulfurized alkylphenol, and condensation products of formaldehyde with a phenolic substance; alcohols such as methanol, 2-propanol, octanol, Cellosolve alcohol, Carbitol alcohol, ethylene glycol, stearyl alcohol, and cyclohexyl alcohol; and amines such as aniline, phenylene diamine, phenothiazine, phenyl-beta-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60 to 200° C. Overbased detergents have a TBN (total base number, ASTM D-2896) typically of 150 or more such as 250–450.

Examples of suitable metal-containing detergents include, but are not limited to, neutral and overbased salts of such substances as calcium phenates, sulfurized calcium phenates, wherein each aromatic group has one or more aliphatic groups to impart hydrocarbon solubility; calcium sulfonates, wherein each sulfonic acid moiety is attached to an aromatic nucleus which in turn usually contains one or more aliphatic substituents to impart hydrocarbon solubility; calcium salicylates wherein the aromatic moiety is usually substituted by one or more aliphatic substituents to impart hydrocarbon solubility, salts of hydrolyzed phosphosulfurized olefins having 10 to 2,000 carbon atoms or of hydrolyzed phosphosulfurized alcohols and/or aliphatic-substituted phenolic compounds having 10 to 2,000 carbon atoms; calcium salts of aliphatic carboxylic acids and aliphatic substituted cycloaliphatic carboxylic acids; and many other salts of oil-soluble organic acids. Mixtures of neutral or over-based salts of two or more different alkali and/or alkaline earth metals can be used. Likewise, neutral and/or overbased salts of mixtures of two or more different acids (e.g. one or more overbased calcium phenates with one or more overbased calcium sulfonates) can also be used.

As is well known, overbased metal detergents are generally regarded as containing overbasing quantities of inorganic bases, probably in the form of micro dispersions or colloidal suspensions. Thus the term "oil soluble" as applied to metallic detergents is intended to include metal detergents wherein inorganic bases are present that are not necessarily completely or truly oil-soluble in the strict sense of the term, inasmuch as such detergents when mixed into base oils behave much the same way as if they were fully and totally dissolved in the oil.

Methods for the production of oil-soluble neutral and overbased metallic detergents and alkaline earth metal-containing detergents are well known to those skilled in the art, and extensively reported in the patent literature. See for example, the disclosures of U.S. Pat. Nos. 2,001,108; 2,081,075; 2,095,538; 2,144,078; 2,163,622; 2,270,183; 2,292,205; 2,335,017; 2,399,877; 2,416,281; 2,451,345; 2,451,346; 2,485,861; 2,501,731; 2,501,732; 2,585,520; 2,671,758; 2,616,904; 2,616,905; 2,616,906; 2,616,911; 2,616,924; 2,616,925; 2,617,049; 2,695,910; 3,178,368; 3,367,867; 3,496,105; 3,629,109; 3,865,737; 3,907,691; 4,100,085; 4,129,589; 4,137,184; 4,184,740; 4,212,752; 4,617,135; 4,647,387; 4,880,550.

The metallic detergents utilized in this invention can, if desired, be oil-soluble boronated neutral and/or overbased alkali of alkaline earth metal-containing detergents. Methods for preparing boronated metallic detergents are described in, for example, U.S. Pat. Nos. 3,480,548; 3,679,584; 3,829,381; 3,909,691; 4,965,003; 4,965,004.

Preferred calcium detergents for use with this invention are overbased calcium sulfonates and phenates and overbased sulfurized calcium phenates.

While any effective amount of the calcium overbased detergent may be used to achieve the benefits of this invention, typically effective amounts will be from 0.01 to 5.0 mass percent in the finished fluid. Preferably the treat rate in the fluid will be from 0.05 to 3.0 mass percent, and most preferred is 0.1 to 1.0 mass percent such that the calcium content of the final oil is below 500 parts per million by weight.

d. Friction Modifiers (1) Succinimides

The succinimide friction modifiers of the current invention are compounds having the structure II:

Structure II

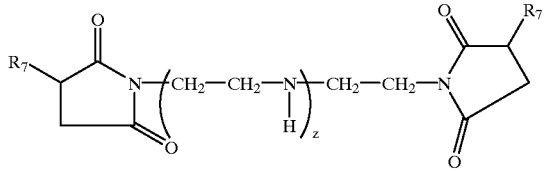

wherein $R_7$ is $C_6$ to $C_{30}$ alkyl, and z=1 to 10.

The alkenyl succinic anhydride starting materials for forming the friction modifiers of structure II can be either of two types. The two types differ in the linkage of the alkyl side chain to the succinic acid moiety. In the first type, the alkyl group is joined through a primary carbon atom in the starting olefin, and therefore the carbon atom adjacent to the succinic acid moiety is a secondary carbon atom. In the second type, the linkage is made through a secondary carbon atom in the starting olefin and these materials accordingly have a branched or isomerized side chain. The carbon atom adjacent to the succinic acid moiety therefore is necessarily a tertiary carbon atom.

The alkenyl succinic anhydrides of the first type, shown as structure III, with linkages through secondary carbon atoms, are prepared simply by heating α-olefins, that is, terminally unsaturated olefins, with maleic anhydride. Examples of these materials would include n-decenyl succinic anhydride, tetradecenyl succinic anhydride, n-octadecenyl succinic anhydride, tetrapropenyl succinic anhydride, etc.

Structure III

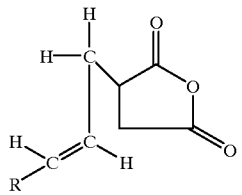

wherein R is $C_3$ to $C_{27}$ alkyl.

The second type of alkenyl succinic anhydrides, with linkage through tertiary carbon atoms, are produced from internally unsaturated olefins and maleic anhydride. Internal olefins are olefins which are not terminally unsaturated, and therefore do not contain the

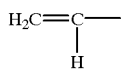

moiety. These internal olefins can be introduced into the reaction mixture as such, or they can be produced in situ by exposing α-olefins to isomerization catalysts at high temperatures. A process for producing such materials is described in U.S. Pat. No. 3,382,172. The isomerized alkenyl substituted succinic anhydrides are compounds having structure IV:

Structure IV

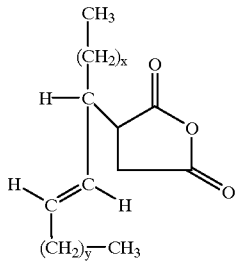

where x and y are independent integers whose sum is from 1 to 30.

The preferred succinic anhydrides are produced from isomerization of linear α-olefins with an acidic catalyst followed by reaction with maleic anhydride. The preferred α-olefins are 1-octene, 1-decene, 1-dodecene, 1-tetradecene, 1-hexadecene, 1-octadecene, 1-eicosane, or mixtures of these materials. The products described can also be produced from internal olefins of the same carbon numbers, 8 to 20. The preferred materials for this invention are those made from 1-tetradecene (x+y=9), 1-hexadecene (x+y=11) and 1-octadecene (x+y=13), or mixtures thereof.

The alkenyl succinic anhydrides are then further reacted with polyamines having the following structure V:

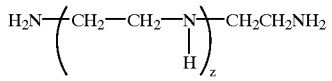

where z is an integer from 1 to 10, preferably from 1 to 3.

The preferred succinimide friction modifiers of this invention are products produced by reacting the isomerized alkenyl succinic anhydride with diethylene triamine, triethylene tetramine, tetraethylene pentamine or mixtures thereof The most preferred products are prepared using tetraethylene pentamine. The alkenyl succinic anhydrides are typically reacted with the amines in a 2:1 molar ratio so that both primary amines are converted to succinimides. Sometimes a slight excess of isomerized alkenyl succinic anhydride is used to insure that all primary amines have reacted. The products of the reaction are compound of structure II.

The two types of succinimide friction modifiers can be used individually or in combination.

The disuccinimides of structure II may be post-treated or further processed by any number of techniques known in the art. These techniques would include, but are not limited to, boration, maleation, and acid treating with inorganic acids such as phosphoric acid, phosphorous acid, and sulfuric acid. Descriptions of these processes can be found in, for example, U.S. Patent No. 3,254,025; U.S. Pat. No. 3,502,677; U.S. Pat. No. 4,686,054; and U.S. Pat. No. 4,857,214.

Another useful derivative of the succinimide modifiers are where the alkenyl groups of structures II, III and IV have been hydrogenated to form their saturated alkyl analogs. Saturation of the condensation products of olefins and maleic anhydride may be accomplished before or after reaction with the amine. These saturated versions of structures II, III and IV may likewise be post-treated as previously described.

While any effective amount of the compounds of structure II and its derivatives may be used to achieve the benefits of this invention, typically these effective amounts will range from 0.01 to 10 wt. % of the finished fluid, preferably from 0.05 to 7 wt. %, most preferably from 0.1 to 5 wt. %.

Examples of methods for producing compounds having structure II are given below.

EXAMPLE FM-2-A

Into a one liter round bottomed flask fitted with a mechanical stirrer, nitrogen sweep, Dean Starke trap and condenser was placed 352 grams (1.00 mol) of isooctadecenylsuccinic anhydride (ODSA obtained from the Dixie Chemical Co.). A slow nitrogen sweep was begun, the stirrer started and the material heated to 130° C. Immediately, 87 grams (0.46 mol) of commercial tetraethylene pentamine was added slowly through a dip tube to the hot stirred isooctadecenylsuccinic anhydride. The temperature of the mixture increased to 150° C. where it was held for two hours. During this heating period 8 mL of water (~50% of theoretical yield) was collected in the Dean Starke trap. The flask was cooled to yield the product and the product weighed and analyzed. Yield: 427 grams. Percent nitrogen: 7.2.

EXAMPLE FM-2-B

The procedure of Example FM-2-A was repeated except that the following materials and amounts were used: n-octadecenylsuccinic anhydride, 352 grams (1.0 mol) and tetraethylene pentamine, 87 grams (0.46 mol). The water recovered was 8 mL. Yield: 430 grams. Percent nitrogen: 7.1.

EXAMPLE FM-2-C

The procedure of Example FM-2-A was repeated except that the following materials and amounts were used: isooctadecenylsuccinic anhydride, 458 grams (1.3 mol) and diethylenetriamine, 61.5 grams (0.6 mol). The water recovered was 11 mL. Yield: 505 grams. Percent nitrogen: 4.97.

EXAMPLE FM-2-D

The procedure of Example FM-2-A was repeated except that the following materials and amounts were used: isohexadecenylsuccinic anhydride (ASA-100 obtained from the Dixie Chemical Co.), 324 grams (1.0 mol), and tetraethylenepentamine, 87 grams (0.46 mol). The water recovered was 9 mL. Yield: 398 grams. Percent nitrogen: 8.1.

EXAMPLE FM-2-E

The product of Example FM-2-A, 925 grams (1.0 mol), and 140 grams of a naphthenic base oil (sold under the trademark Necton-37® and available from Exxon Chemical Co.) and 1 gram of anti-foamant DC-200 sold by Dow Corning were placed in a 2 liter round bottomed flask fitted with a heating mantle, an overhead stirrer, a nitrogen sweep, a Dean Starke trap and a condenser. The solution was heated to 80° C. and 62 grams (1.0 mol) of boric acid was added. The mixture was heated to 140° C. and held at this temperature for 3 hours. During this heating period 3 mL of water was collected in the Dean Starke trap. The product was cooled, filtered, weighed, and analyzed. Yield: 1120 grams. Percent nitrogen: 6.1; percent boron: 0.9.

(2) Ethoxylated Amines ethoxylated amine friction modifiers of the current invention are compounds having structure VI:

Structure VI

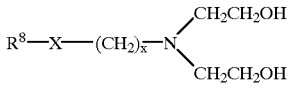

wherein $R_8$ is a $C_6$ to $C_{28}$ alkyl group, X is O, S or $CH_2$, and x=1 to 6.

Alkoxylated amines are a particularly suitable type of friction modifier for use in this invention. Preferred amine compounds contain a combined total of from about 18 to about 30 carbon atoms. In a particularly preferred embodiment, this type of friction modifier is characterized by structure VI where X represents oxygen, $R_8$ contains a total of 18 carbon atoms, and x=3.

Preparation of the amine compounds, when X is oxygen and x is 1, is, for example, by a multi-step process where an alkanol is first reacted, in the presence of a catalyst, with an unsaturated nitrile such as acrylonitrile to form an ether nitrile intermediate. The intermediate is then hydrogenated, preferably in the presence of a conventional hydrogenation catalyst, such as platinum black or Raney nickel, to form an ether amine. The ether amine is then reacted with an alkylene oxide, such as ethylene oxide, in the presence of an alkaline catalyst by a conventional method at a temperature in the range of about 90–150° C.

Another method of preparing the amine compounds, when X is oxygen and x is 1, is to react a fatty acid with ammonia or an alkanol amine, such as ethanolamine, to form an intermediate which can be further oxyalkylated by reaction with an alkylene oxide, such as ethylene oxide or propylene oxide. A process of this type is discussed in, for example, U.S. Pat. No. 4,201,684.

When X is sulfur and x is 1, the amine friction modifying compounds can be formed, for example, by effecting a conventional free radical reaction between a long chain α-olefin with a hydroxyalkyl mercaptan, such as β-hydroxyethyl mercaptan, to produce a long chain alkyl hydroxyalkyl sulfide.

The long chain alkyl hydroxyalkyl sulfide is then mixed with thionyl chloride at a low temperature and then heated to about 40° C. to form a long chain alkyl chloroalkyl sulfide. The long chain alkyl chloroalkyl sulfide is then caused to react with a dialkanolamine, such as diethanolamine, and, if desired, with an alkylene oxide, such as ethylene oxide, in the presence of an alkaline catalyst and at a temperature near 100° C. to form the desired amine compounds. Processes of this type are known in the art and are discussed in, for example, U.S. Pat. No. 3,705,139.

In cases when X is oxygen and x is 1, the present amine friction modifiers are well known in the art and are described in, for example, U.S. Pat. Nos. 3,186,946, 4,170,560, 4,231,883, 4,409,000 and 3,711,406.

Examples of suitable amine compounds include, but are not limited to, the following: N,N-bis(2-hydroxyethyl)-n-dodecylamine; N,N-bis(2-hydroxyethyl)-1-methyl-tridecenylamine; N,N-bis(2-hydroxyethyl)-hexadecylamine; N,N-bis(2-hydroxyethyl)-octadecylamine; N,N-bis(2-hydroxyethyl)-octadecenyl-amine; N,N-bis(2-hydroxyethyl)-oleylamine; N-(2-hydroxyethyl)-N-(hydroxy-ethoxyethyl)-n-dodecylamine; N,N-bis(2-hydroxyethyl)-n-dodecyloxyethylamine; N,N-bis(2-hydroxyethyl)-dodecylthioethylamine; N,N-bis(2-hydroxyethyl)-dodecyl-thiopropylamine; N,N-bis(2-hydroxyethyl)-hexadecyloxypropylamine; N,N-bis(2-hydroxyethyl)-hexadecylthiopropylamine; N-2-hydroxyethyl,N-[N',N'-bis(2-hydroxyethyl) ethylamine]-octadecylamine; and N-2-hydroxyethyl,N-[N',N'-bis(2-hydroxyethyl)ethylamine]-stearylamine.

The most preferred additive is N,N-bis(2-hydroxyethyl)-hexadecyloxypropylamine which is sold by the Tomah Chemical Co. under the designation E-22-S-2.

The amine compounds may be used as such, however, they may also be used in the form of an adduct or reaction product with a boron compound, such as a boric oxide, a boron halide, a metaborate, boric acid, or a mono-, di-, and trialkyl borate. Such adducts or derivatives may be illustrated, for example, by the following structural formula:

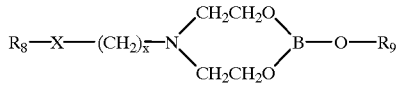

where $R_8$, X, and x are the same as previously defined for structure VI and where $R_9$ is either hydrogen or an alkyl radical.

These ethoxylated amine friction modifiers are present in amounts of 0.01 to 1.0 wt. %, preferably 0.05 to 0.75 wt. %, most preferably 0.1 to 0.5 wt. % of the composition.

e. Primary Amides

Preferred primary amides of long chain carboxylic acids are represented by the structure below:

$RCONH_2$ wherein R is preferably an alkenyl or alkyl group having about 12 to 24 carbons, R is most preferably a $C_{17}$ alkenyl group. The preferred primary amide is oleamide. Oleamide is preferably present in an amount between about 0.001 to 0.50 wt. %, based upon the weight percent of the fully formulated oil composition, most preferably present in an amount of 0.1 wt. %.

Other additives known in the art may be added to the power transmitting fluids of this invention. These additives include dispersants, antiwear agents, corrosion inhibitors, metal detergents, extreme pressure additives, and the like. Such additives are disclosed in, for example, "Lubricant Additives" by C. V. Smalheer and R. Kennedy Smith, 1967, pp. 1–11 and U.S. Pat. No. 4,105,571.

Representative amounts of these additives in a CVTF are summarized as flows:

| Additive | Broad Wt. % | Preferred Wt. % |
|---|---|---|
| VI Improvers | 1–12 | 1–4 |
| Corrosion Inhibitor | 0.01–3 | 0.02–1 |
| Dispersants | 0.10–10 | 2–5 |
| Antifoaming Agents | 0.001–5 | 0.001–0.5 |
| Detergents | 0.01–6 | 0.01–3 |
| Antiwear Agents | 0.001–5 | 0.2–3 |
| Pour Point Depressants | 0.01–2 | 0.01–1.5 |
| Seal Swellants | 0.1–8 | 0.5–5 |
| Lubricating Oil | Balance | Balance |

The additive combinations of this invention may be combined with other desired lubricating oil additives to form a concentrate. Typically the active ingredient (a.i.) level of the concentrate will range from 20 to 90 wt. % of the concentrate, preferably from 25 to 80 wt. %, most preferably from 35 to 75 wt. %. The balance of the concentrate is a diluent typically comprised of a lubricating oil or solvent.

The following examples are given as specific illustrations of the claimed invention. It should be understood, however, that the invention is not limited to the specific details set forth in the examples. All parts and percentages are by weight unless otherwise specified.

EXAMPLES

For the purpose of exemplifying the benefits of this invention, two fluids were prepared, Fluid 1 which fully meets the requirements of the claimed invention, and Fluid IC, which is identical to Fluid 1, except it does not contain the primary amide of a long chain carboxylic acid (oleamide). Fluid 1C is prepared as a comparative example. The composition of fluids 1 and 1C are given below:

TABLE 2

Test Fluid Compositions

| Component | Fluid 1 | Fluid 1C |
|---|---|---|
| 950MW Polyisobutenyl Succinimide Ashless Dispersant | 3.80% | 3.80% |
| Phosphite of Example P-1-B | 0.36 | 0.36 |
| Calcium Sulfonate Overbased Detergent | 0.50 | 0.50 |
| Succinimide Friction Modifier, Example FM-2-C | 0.23 | 0.23 |
| Oleamide | 0.05 | 0.00 |
| Base Fluid* | 95.06 | 95.11 |

*Base fluid comprises lubricating oil base stocks, viscosity modifiers and other additives.

Improved Low Temperature Friction Characteristics:

To demonstrate the improved frictional characteristics of the compositions of this invention at low temperatures, the frictional characteristics of both Fluids 1 and 1C were evaluated by use of the Low Velocity Friction Apparatus. This apparatus is commonly used to measure the temperature dependence of friction as well as the speed dependence of friction ($d\mu/dV$) of transmission lubricants.

Figure 1B:
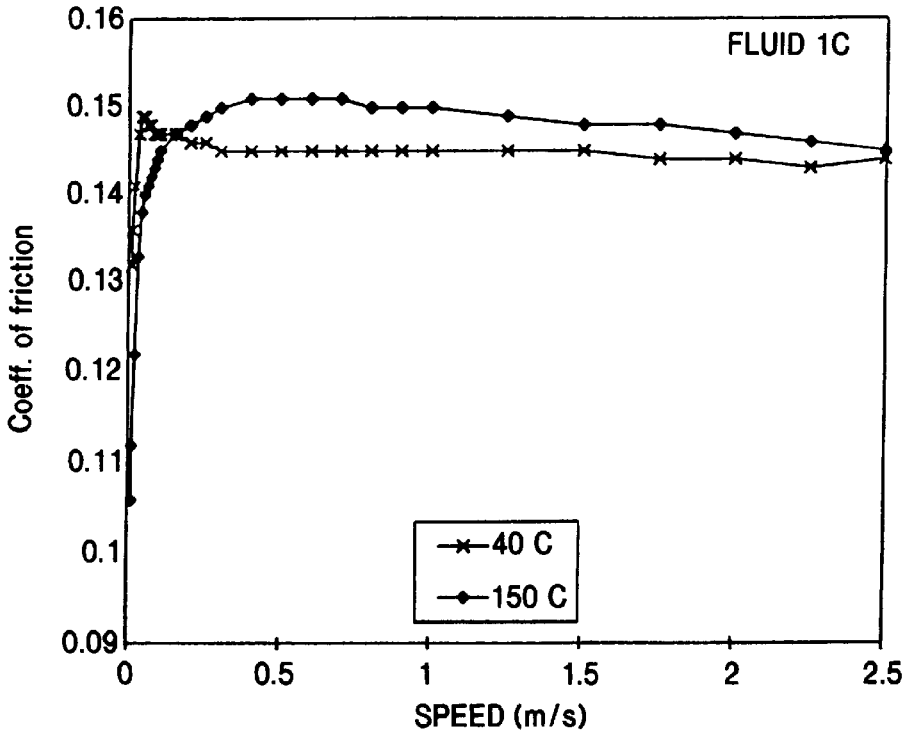
Figure 2A:
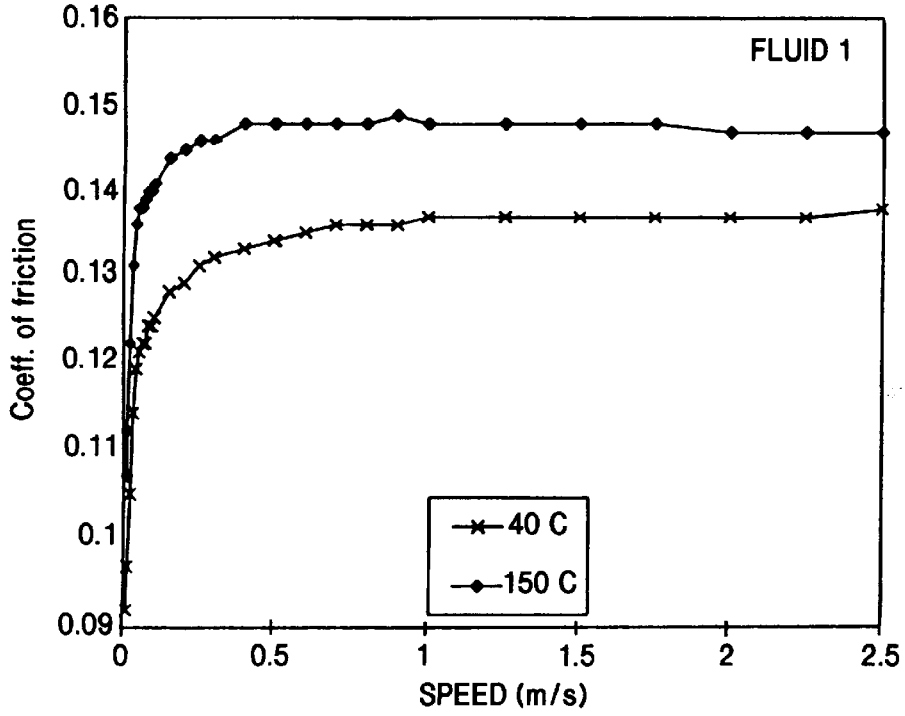
FIGS. 2*a* and 2*b* are graphs depicting the friction versus velocity curves for two lubricants at both 40° C. and 150° C. after aging (aged fluid).
Figure 2B:
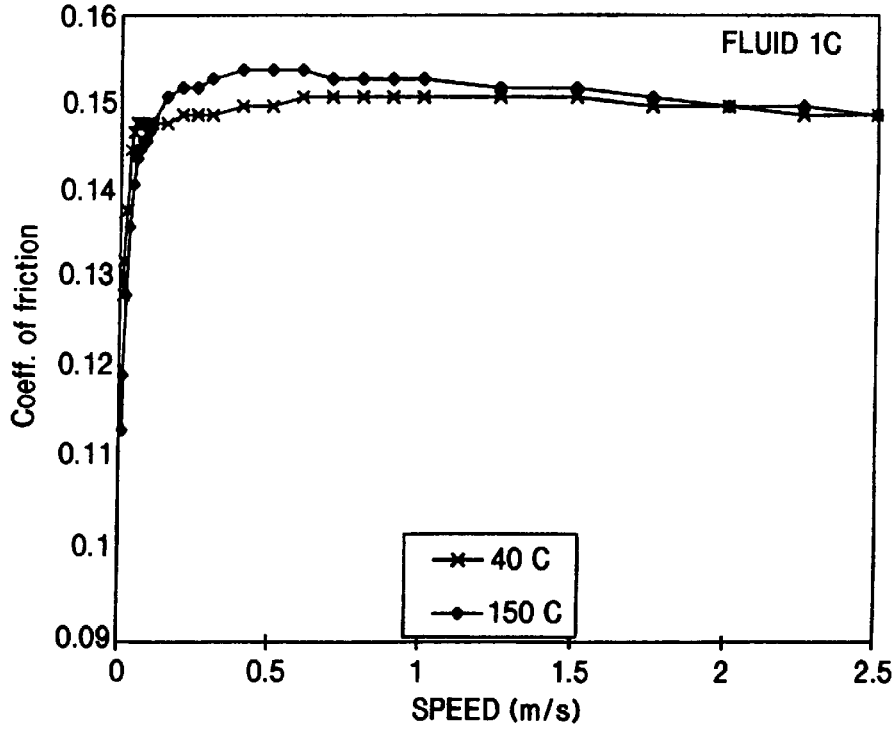

The results of this testing can be seen in FIGS. 1 and 2. FIG. 1 shows the friction versus velocity curves for the two lubricants at both 40° C. and 150° C. prior to any aging (fresh fluid). In both graphs, Fluid 1 and Fluid 1C, acceptable $d\mu/dV$ characteristics are exhibited at 150° C. 'Acceptable' is defined as the friction coefficient always increasing with increasing speed. A closer examination reveals that in this respect Fluid 1 is better, even at 150° C. than Fluid 1C. The result for Fluid 1 at 150° C. is representative of an ideal friction versus velocity curve. The critical difference in the two fluids occurs at 40° C. Fluid 1 has an acceptable friction versus velocity relationship at 40° C., whereas the 40° C. curve for Fluid 1C is totally unacceptable. The curve has a steep negative slope between 0.001 and 0.2 m/s and a gentle negative slope from about 0.2 to 2.5 m/s. FIG. 2 shows the same data after the two fluids have been aged at 150° C. for 3 hours. Now the 40° C. friction versus velocity curve for Fluid 1 parallels the ideal 1 50° C. curve; while the curve for Fluid 1C is still slightly negative and very harsh.

This simple experiment shows that the compositions of this invention, containing primary amides of long chain carboxylic acids, provide CVT lubricants with superior friction characteristics, especially at low temperatures.

Specific features and examples of the invention are presented for convenience only, and other embodiments according to the invention may be formulated that exhibit the benefits of the invention. These alternative embodiments will be recognized by those skilled in the art from the teachings of the specification and are intended to be embraced within the scope of the appended claims.

What is claimed is:

1. A zinc-free lubricating composition for lubricating a continuously variable transmission, the lubricating composition comprising a mixture of:

(1) a major amount of a lubricating oil; and (2) an effective amount of a performance enhancing additive combination comprising:

(a) an ashless dispersant;

(b) at least one organic phosphite having the following structure:

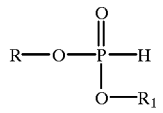

where R is hydrocarbyl and $R_1$ is hydrocarbyl or hydrogen;

(c) a calcium detergent;

(d) one or more friction modifiers selected from the group consisting of:

(1) succinimides having the structure

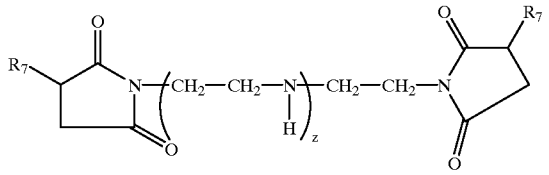

wherein $R_7$ is $C_6$ to $C_{30}$ alkyl, and z=1 to 10, and (2) ethoxylated amines; and (e) a primary amide of a long chain carboxylic acid.

2. The lubricating composition of claim 1 wherein said primary amide is represented by the general structure:

RCONH2 wherein R is an alkyl or alkenyl group having about 12 to 24 carbons.

3. The lubricating composition of claim 2 wherein said primary amide is oleamide.

4. The lubricating composition of claim 1 wherein said primary amide is present in an amount between about 0.001 to 0.05 wt. %, based upon the weight percent of lubricating composition.

5. The lubricating composition of claim 1 wherein said ethoxylated amines have the structure

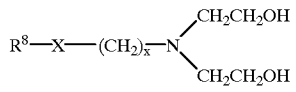

wherein $R_8$ is a $C_6$ to $C_{28}$ alkyl group, X is O, S or $CH_2$, and x=1 to 6 or the reaction product of an ethoxylated amine with a boron compound, the reaction product having the structure:

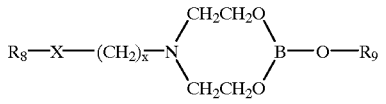

where $R_8$ is a $C_6$ to $C_{28}$ alkyl group, $R_9$ is either hydrogen or an alkyl radical, X is O, S or $CH_2$, and x=1 to 6.

6. The lubricating composition of claim 1, wherein said organic phosphite has R groups selected from the group consisting of: 3-thiapentyl, 3-thiaheptyl, 3-thiaundecyl, and 3-thiapentadecyl.

7. The lubricating composition according to claim 5, wherein said friction modifier is said ethoxylated amine where X is oxygen, $R_8$ contains a total of 18 carbon atoms, and x=3.

8. The lubricating composition of claim 7, wherein said ethoxylated amine is N,N-bis(2-hydroxyethyl) hexadecyloxypropylamine.

9. The lubricating composition of claim 1, wherein said friction modifier is the reaction product of the ethoxylated amine and a boronating agent compound.

10. The lubricating composition of claim 1 containing a succinimide friction modifier and an ethoxylated amine friction modifier.

11. The lubricating composition of claim 1, wherein said lubricating oil contains a synthetic base oil.

12. The lubricating composition of claim 1, wherein said calcium detergent is calcium sulfurized phenate.

13. The lubricating composition of claim 1, wherein said ashless succinimide dispersant is a polyisobutenyl succinimide.

14. A performance-enhancing additive composition comprising a mixture of:

(a) an ashless dispersant;

(b) at least one organic phosphite having the following structure:

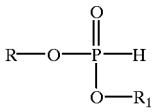

where R is hydrocarbyl and $R_1$ is hydrocarbyl or hydrogen;

(c) a calcium detergent;

(d) one or more friction modifiers selected from the group consisting of:

(1) succinimides having the structure

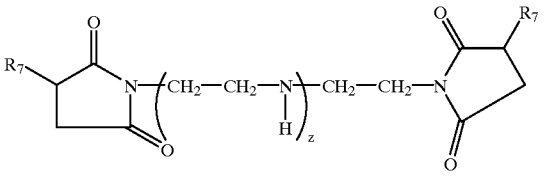

wherein $R_7$ is $C_6$ to $C_{30}$ alkyl, and z=1 to 10, and (2) ethoxylated amines; and (e) a primary amide of a long chain carboxylic acid.

15. The additive of claim 14, wherein the components are blended at temperatures above 55° C.

16. The composition of claim 1 wherein the calcium content is less than 500 ppm.

17. A method of lubricating a continuously variable transmission using the lubricating composition of claim 1 which comprises adding the lubricating composition of claim 1 to the transmission.

18. A CVT apparatus containing the fluid of claim 1.

* * * * *